United States Patent [19]

Herrington

[11] 4,410,130

[45] Oct. 18, 1983

[54] PROTECTIVE STRIP FOR Z-FOLD BAG CLOSURE

[75] Inventor: Fox J. Herrington, Holcomb, N.Y.

[73] Assignee: Mobil Oil Corporation, New York, N.Y.

[21] Appl. No.: 335,955

[22] Filed: Dec. 30, 1981

[51] Int. Cl.[3] ..... B65D 33/20

[52] U.S. Cl. ..... 383/62; 206/632; 383/86

[58] Field of Search ..... 150/1, 3, 7; 229/62; 206/260

[56] References Cited

U.S. PATENT DOCUMENTS

| | | | |
|---|---|---|---|
| Re. 28,969 | 9/1976 | Naito | 150/3 |
| 3,339,606 | 9/1967 | Kugler | 150/3 |
| 3,420,433 | 1/1969 | Bostwick | 229/80 |
| 3,670,876 | 6/1972 | Davis | 229/80 X |
| 3,990,627 | 11/1976 | Olson | 229/62 |
| 4,186,786 | 2/1980 | Kirkpatrick | 150/3 |
| 4,199,062 | 4/1980 | Johnston et al. | 150/1 X |

*Primary Examiner*—William Price
*Assistant Examiner*—Sue A. Weaver
*Attorney, Agent, or Firm*—A. J. McKillop; M. G. Gilman; J. F. Powers, Jr.

[57] ABSTRACT

An improved Z-fold closure for flexible bags such as thermoplastic bags comprising polyethylene film comprising a pressure sensitive adhesive strip and a protective strip having one or more ribs of sufficient stiffness and dimension so that the strip of adhesive is substantially contacted by only the top portion(s) of the rib(s) when the bag closure is in a stored or "z" fold position.

8 Claims, 10 Drawing Figures

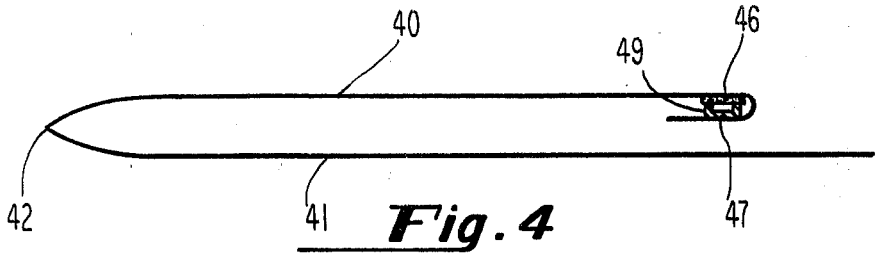
Fig. 4
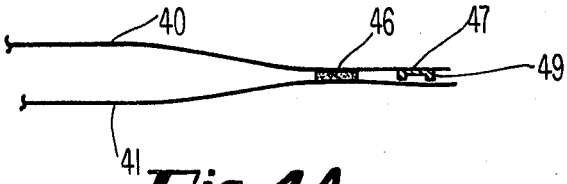
Fig. 4A
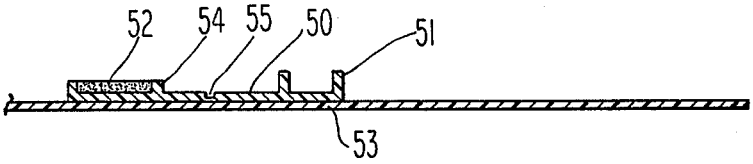
Fig. 5
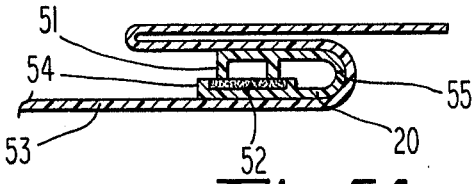
Fig. 5A
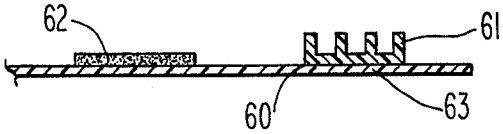
Fig. 6
Fig. 7
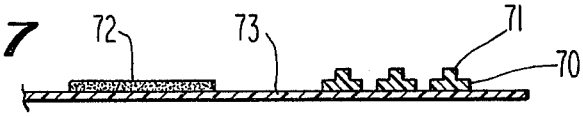
Fig. 8
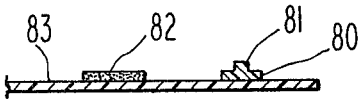

PROTECTIVE STRIP FOR Z-FOLD BAG CLOSURE

BACKGROUND OF THE INVENTION

1. Field of the Invention

This invention relates to an improved closure for flexible bags such as thermoplastic bags comprising polyethylene. Related applications assigned to the same assignee as this application include the following copending and concurrently filed applications: "Adhesive Channel Closure for Flexible Bags," Ser. No. 335,798, filed Dec. 30, 1981; "Laminated Pressure Sensitive Adhesive Systems for Use in Plastic Bags," Ser. No. 335,799, filed Dec. 30, 1981; "Manufacturing Process for Channel Seal," Ser. No. 365,814, filed Apr. 5, 1982; and "Adhesive Bag Closure That Opens Easily By Hand But Resists Opening By Contents", Ser. No. 335,800, filed Dec. 30, 1981, the last two applications being incorporated by reference herein.

2. Brief Description of the Prior Art

A variety of closures have been developed for use with flexible bags such as thermoplastic bags made out of polyethylene film. These closures included the so-called profile bags where the closure comprises one or more sets of mating channels. One example of a profile closure is the Zip-loc storage bag as found in U.S. Pat. No. Re. 28,969 to Naito. U.S. Pat. No. 4,186,786 to Kirkpatrick shows colored channels so that the user may more easily detect complete occlusion of profile bag openings.

Other types of bag closures use one or more adhesive strips. See, for example, U.S. Pat. No. 3,670,876 to Davis. A major problem with adhesive closures has been that the adhesive must be able to form a good resealable closure when contacted with the other surface forming the bag opening, and yet the adhesive must be storable in a package with other bags without destructively adhering to the other bags.

An attempt to combine a profile closure with an adhesive may be seen in U.S. Pat. No. 3,339,606 to Kugler. The releasable closure in the Kugler patent comprises a tongue on one member and a groove on the other member where the tongue is of a thickness less than the width of the groove and wherein a releasable pressure sensitive adhesive is provided to keep the tongue within the groove. This structure, however, still requires registration of mating channels.

Attempts have also been made to protect the adhesive strip until the bag is used. In U.S. Pat. No. 3,420,433 to Bostwick a closure flap having an adhesive applied thereto is folded or overflapped upon itself to form a protective enclosure for the adhesive prior to the use of the bag.

In U.S. Pat. No. 3,990,627 to Olson (and assigned to the same assignee as this application), a Z-fold adhesive closure for bags is disclosed wherein the adhesive strip is covered by the upper portion of the bag's front wall until ready for use. It is difficult, however, to find an adhesive which is easy to apply, which is strong enough to form an effective seal upon closure, but which does not cause undesirable problems by sticking too strongly to the front wall closed over the adhesive in a stored position. An alternate embodiment of the Olson patent uses a release tape permanently secured to the inner surface of the bag's front wall flap, whereby when the flap is folded back upon itself, the release tape is brought into protective covering relationship with the adhesive strip located on the inner surface of the front-wall flap. The use of a release layer is not desirable for plastic bag closures because of the expense and difficulty in manufacture and because release material may transfer to the adhesive layer.

For Z-fold type bags the problems in constructing a resealable closure capable of forming a satisfactory seal are compounded by the intimate contact between the adhesive strip and the protective strip or overflap. It is desirable that the initial exposure of the adhesive strip be accomplished with as little force as possible, yet the adhesive must be sufficiently aggressive to hold adequately when it is used to close the bag. In practice this is difficult to accomplish because pressure-sensitive adhesives, especially those of the hot-melt type, typically increase in adhesion as they are left in contact for a long period of time. Since the Z-fold is left in contact for a very long time (from the time the bag is manufactured until it is used), normally the force to expose the adhesive strip for the first time is the maximum for a given adhesive material. One way in which this problem has been reduced in the past has been by the use of corona discharge treatment of the film only in the areas to be contacted by the adhesive for final closure. Since adhesives stick more to treated surfaces, this gives a preferentially greater adhesion in final use, allowing a lower tack adhesive material to be used so that the Z-fold is easier to open for initial exposure. This type of closure is not fully satisfactory because only a small differential in adhesion is achieved by such treatment.

Thus, it is an object of the present invention to provide an improved Z-fold closure which minimizes the contact between an adhesive strip and a protective strip. It is a further object of this invention to provide an improved Z-fold closure which may utilize a stronger adhesive. It is yet another object of this invention to provide an improved Z-fold closure which maintains separability of its adhesive strip and protective strip even during prolonged storage. These and other objects of the invention will be apparent from the following explanation.

SUMMARY OF THE INVENTION

The present invention provides an improved Z-fold closure comprising a pressure-sensitive adhesive strip and a protective strip having at least one rib of sufficient stiffness and dimension such that the strip of adhesive is substantially contacted by and preferably only contacted by the top portion(s) of the rib(s) when in the stored "Z" position. The protective strip and the adhesive strip are applied along sections of a bag opening at preselected distances from each other and the edge or the opening so that a Z-fold may be formed when the bag is in a stored position. The closure of this invention allows a stronger adhesive to be used even when the bag is subjected to prolonged storage. A preferred embodiment comprises a channel structure having at least two ribs.

BRIEF DESCRIPTION OF THE DRAWINGS

FIG. 4 is a cross-section of a bag having first and second walls of substantially the same length and having a closure constructed in accordance with the first embodiment of this invention in a stored position;

FIG. 4A shows the embodiment of FIG. 4 in a sealed position;

FIG. 5 is an enlarged cross-sectional view of a section of a closure constructed with a second embodiment of this invention in an open position;

FIG. 5A is a cross-sectional view of the embodiment of FIG. 5 in a stored or folded condition;

FIG. 6 is a cross-sectional view of a third embodiment of this invention in an open position;

FIG. 7 is a cross-sectional view of a fourth embodiment of this invention in an open position; and FIG. 8 is a cross sectional view of the fourth embodiment constructed with a single rib.

DETAILED DESCRIPTION OF THE DRAWINGS

Figure 1:
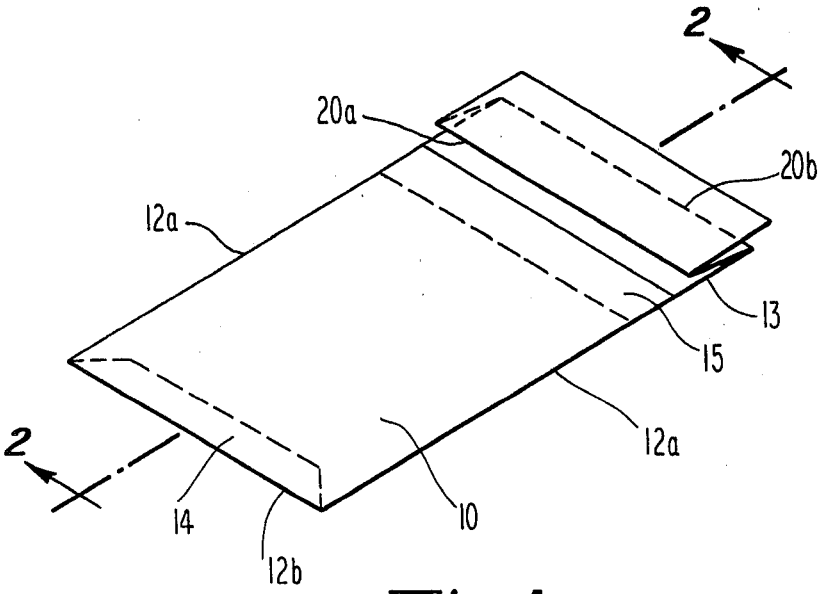
FIG. 1 is a perspective view of a Z-fold bag having a closure constructed in accordance with a first and preferred embodiment of this invention as seen in a stored or folded condition.
Figure 2:
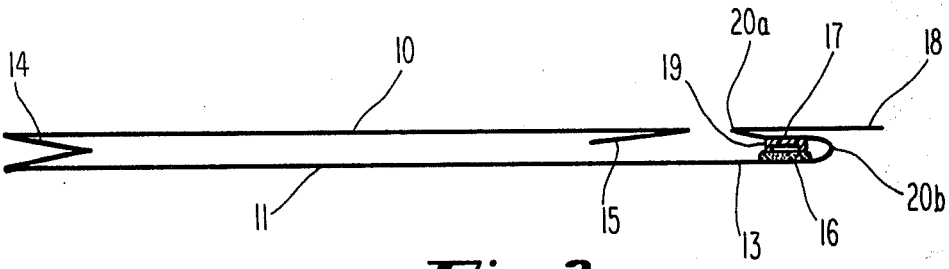
FIG. 2 is a cross-section of the bag of FIG. 1 taken along reference line 2—2.

FIGS. 1 and 2 show a bag having a Z-fold closure constructed in accordance with a first and preferred embodiment of this invention in a stored or folded condition, i.e., with the protective strip folded over the adhesive strip. To form a bag body a first wall 10 is connected to a second wall 11 along seal lines 12*a* and bottom portions 12*b*. Optionally, the bag body may be constructed with a gusset 14 (shown in phantom in FIG. 1 and in cross-section in FIG. 2). The bag body in FIGS. 1 and 2 shows an embodiment in which second wall 11 terminates in a flap 13 whose edges are free or unsealed. In this embodiment first wall 10 is shown as terminating in an optional interior fold of film or interior flap 15 whose edges are sealed into place along the top sections of lines 12*a*. A first embodiment of the improved Z-fold closure of this invention is shown in a stored position. The closure comprises a layer of pressure sensitive adhesive 16 which extends transversely across an inner surface of flap 13 and is located a preselected distance away from the end 18 of the flap 13. A protective strip 17 comprising channel walls or ribs 19 of sufficient stiffness and dimension (including size and spacing of ribs) is affixed to the flap 13 at a preselected distance from the adhesive strip, such that in a stored position the surface of the adhesive strip is substantially contacted by only the top portions of the ribs. Thus, channel strip 17 is contacted with adhesive strip 16 by folding flap 13 along lines 20*a* and 20*b* and forming a Z-fold.

Figure 3:
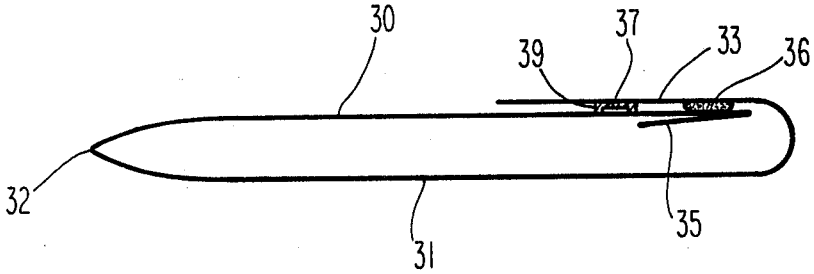
FIG. 3 is a cross-section of a bag with an elongated flap having a closure constructed in accordance with the first embodiment of this invention in a sealed position.

FIG. 3 shows a cross-section of a bag constructed with the first embodiment in a sealed position. First wall 30 and second wall 31 are sealingly connected along a major portion of their sides and bottom line 32, e.g., a fold in the film or a heat seal line, to form a bag body. The bag body in FIG. 3 is shown with first wall 30 terminating in an optional interior fold of film or interior flap 35 whose edges are preferably sealed along the same lines as first wall 30 and second wall 31. In this embodiment second wall 31 is shown as terminating in a flap 33 whose edges are free or unsealed. Protective channel strip 37 with ribs 39 has been pulled away from adhesive strip 36 to expose the surface of the pressure sensitive adhesive. In the sealed position shown in FIG. 3, adhesive strip 36 has been contacted with a surface portion of first wall 30 and pressed into a sealed position.

FIGS. 4 and 4A show the first embodiment of this closure of this invention positioned on an alternate type of bag body. The alternate bag body has a first wall 40 and a second wall 41 which are of substantially the same length and which are sealingly connected along a major portion of their sides and bottom line 42, e.g., a fold in the film or a heat seal line. In a stored position as shown in FIG. 4 the adhesive strip 46 is protected by the channel structure 47 comprising ribs 49. In the sealed position as shown in FIG. 4A, channel strip 47 having ribs 49 has been pulled away to expose the surface of the pressure sensitive adhesive strip 46. Adhesive strip 46 has been contacted with an interior surface portion of second wall 41 and pressed into contact therewith to form a sealed closure.

FIG. 5 is an enlarged view of a second embodiment of a closure constructed in accordance with this invention comprising an adhesive strip and a protective strip. Surface 53, e.g., a flap of a bag body, has positioned thereon a unitary base 50. At one end of base 50 is a protective channel structure comprising ribs 51 affixed to base 50 or formed integrally therewith. At the other end of the unitary base 50 is a pressure sensitive adhesive strip 52 bounded by containment ribs 54. Intermediate the protective strip and the adhesive strip on base 50 is formed a groove 55 to allow the protective strip to be folded over the adhesive strip. As shown more clearly in FIG. 5A, the dimensions of ribs 51 (including height, width, and spacing between ribs) are selected such that the ribs 51 fit between the containment ribs 54. Additionally, ribs 51 are selected to be of sufficient stiffness that the surface of the pressure sensitive adhesive layer 52 is substantially contacted by the top portions of ribs 51 when in a stored position.

FIG. 6 shows a third embodiment of the invention comprising a surface 63 to which has been affixed an adhesive strip 62 and a protective strip comprising a base portion 60 and a plurality of ribs 61 (shown as four ribs here for exemplary purposes) affixed thereto or formed as an integral part therewith. The number of ribs 61 and their dimensions are selected such that in a stored position the surface of the adhesive layer 62 is substantially contacted by the tops of ribs 61.

FIG. 7 shows a fourth embodiment of the invention which is similar to that shown in FIG. 6 except that the protective strip has a discontinuous base 70. Thus, adhesive strip 72 is applied to surface 73. A protective strip comprising a discontinous base 70, comprising a plurality of sections (shown as three here for exemplary purposes) wherein each section has at least one rib 71.

FIG. 8 shows a variation of the embodiment in FIG. 7 in which a protective strip comprising base 80 and a single rib 81 has been affixed to a preselected portion of surface 83. A layer of adhesive 82 has been applied to base 83 at a distance from the protective strip. This single rib 81 may either be constructed to be substantially parallel to a straight edge of the bag or it may be constructed to have a wave-shaped rib of a substantially uniform height.

A preferred embodiment of this invention comprises a bag body made of film comprising polyethylene and a channel structure comprising polyethylene. Optionally, additives may be used, e.g., ethylene vinyl acetate (EVA) to enhance the adherence of the protective channel to the film.

The protective strip of this invention may be coated with a release agent or separating layer, e.g. glycerol monooleate or silicon grease, to facilitate the separation of the protective strip from the adhesive layer. Since usually only the top portion of the rib (or ribs) contacts the adhesive, there is a reduced contamination problem.

Other variations include the use of multi-layered adhesive systems for the adhesive strip and/or colored channels or adhesive to more easily visually identify the location of these members.

A variety of materials and dimensions may be used for the various components of the improved Z-fold closure of this invention. For a closure constructed in accordance with the first embodiment in which the protective strip and a base strip over which the adhesive layer was applied the strips may comprise 49% of an EVA copolymer (3165, from DuPont, comprising 18% vinyl acetate), 49% high density polyethylene (7810, from DuPont), and 2% red masterbatch #10-7621. The strips should be extruded at an elevated temperature, such as about 335° F., onto a film comprising polyethylene as the film passes, over a heated roller maintained at about 165° F. A preselected area of the film may have been pretreated such as by treating a 5 inch width with 70 watts. An adhesive system may be applied to the base strip or film surface; for example, a hot melt adhesive (3P-84008, from Swift) may be applied in a strip about 0.110 inches wide and a thickness of about 2.3 mils with an overcoating of acrylic water-borne adhesive (#9292, from National Adhesives, 5% in water). A release agent comprising 7½% solution of glycerol monooleate in isopropyl alcohol may optionally be applied to the protective strip. The final width of the adhesive base strip may be formed to be about 0.140 inches. The final width of a protective channel strip may be formed to be about 0.090 inches.

While a number of embodiments have been described, other variations which are within the spirit and scope of the invention will occur to those skilled in the art.

What is claimed is:

1. In a thermoplastic bag comprising a first wall and a second wall, said walls being sealingly joined along a major portion of their sides and bottom portions, an open mouth portion proximate to the top edges of said walls, said open mouth portion of said bag having a flap member which is an extension of the second bag wall, said flap having free longitudinal edges and a closure comprising a strip of pressure sensitive adhesive which extends transversely across a portion of an inner surface of said flap a preselected distance from the edge of said flap, said flap further comprising a protective strip a preselected distance from said adhesive strip, said distance between said adhesive strip and said protective strip being utilized to fold the flap back upon itself, the improvement comprising said protective strip having at least two ribs forming a channel of sufficient stiffness and dimension such that in a stored position the surface of said adhesive strip is substantially contacted by at least one of said ribs.

2. A bag having the improved closure of claim 1 wherein said bag comprises polyethylene.

3. A bag having the improved closure of claim 1 or 2 wherein said protective strip and said adhesive strip are on a unitary base which further comprises a groove intermediate said protective strip and said adhesive strip.

4. A bag having the improved closure of claim 1 wherein said closure is a Z-fold.

5. In a thermoplastic bag comprising a first wall and a second wall, said walls being sealingly joined along a major portion of their sides and bottom portions, an open mouth portion proximate to the top edges of said walls, said open mouth portion of said bag having a flap member which is an extension of the second bag wall, said flap having free longitudinal edges and a closure comprising a strip of pressure sensitive adhesive which extends transversely across a portion of an inner surface of said flap a preselected distance from the edge of said flap, said flap further comprising a protective strip a preselected distance from said adhesive strip, said distance between said adhesive strip and said protective strip being utilized to fold the flap back upon itself, the improvement comprising said protective strip having at least one rib of sufficient stiffness and dimension such that in a stored position the surface of said adhesive strip is substantially contacted by said at least one rib, said protective strip and said adhesive strip being on a unitary base which further comprises a groove intermediate said protective strip and said adhesive strip.

6. In a thermoplastic bag comprising a first wall and a second wall, said walls being sealingly joined along a major portion of their sides and bottom portions, an open mouth portion proximate to the top edges of said walls, said open mouth portion of said bag having a flap member which is an extension of the second bag wall, said flap having free longitudinal edges and a closure comprising a strip of pressure sensitive adhesive which extends transversely across a portion of an inner surface of said flap a preselected distance from the edge of said flap, said flap further comprising a protective strip a preselected distance from said adhesive strip, said distance between said adhesive strip and said protective strip being utilized to fold the flap back upon itself, the improvement comprising said protective strip having a base portion and at least one rib extending upwardly from said base portion, said at least one rib being narrower than said base portion to minimize protective strip contact with said adhesive strip and of sufficient stiffness and dimension such that in a stored position the surface of said adhesive strip is substantially contacted only by the top portion of said at least one rib.

7. A bag having the improved closure of claim 6 wherein said protective strip comprises a channel structure having at least two of said ribs extending upwardly from said base portion.

8. A bag having the improved closure of claim 6 wherein said closure is a Z-fold.

* * * * *